US005151018A

United States Patent [19]

Clendenin et al.

[11] Patent Number: 5,151,018

[45] Date of Patent: Sep. 29, 1992

[54] SOUND ATTENUATION CHAMBER

[75] Inventors: Harry B. Clendenin; James F. Fogt, both of Sidney, Ohio

[73] Assignee: Copeland Corporation, Sidney, Ohio

[21] Appl. No.: 560,104

[22] Filed: Jul. 31, 1990

[51] Int. Cl.[5] ..... F04B 39/00; G10K 11/00

[52] U.S. Cl. ..... 417/312; 62/296; 181/202; 417/313; 417/572

[58] Field of Search ..... 417/312, 313, 902, 572, 417/423.14, 423.15, 415, 360, 410; 62/296; 310/51; 181/200, 202, 198

[56] References Cited

U.S. PATENT DOCUMENTS 1,610,774 12/1926 Hanson ..... 417/312
1,967,035 7/1934 Lipman ..... 417/410 X
2,177,827 10/1939 Hintze .
2,200,222 5/1940 Tarleton .
2,247,950 7/1941 Kucher .
2,928,589 3/1960 Davey .
2,961,149 11/1960 Hull .
3,101,891 8/1963 Frank .
3,356,293 12/1967 Butts .
3,465,954 9/1969 Ellis .
3,527,969 9/1970 Papst .
3,714,795 2/1973 Fowell et al. ..... 62/259.1 X
3,857,652 12/1974 Thayer .
4,033,707 7/1977 Stutzman .
4,091,638 5/1978 Mitch .
4,258,821 3/1981 Wendt et al. .
4,347,042 8/1982 Holdsworth .
4,347,043 8/1982 Morris .
4,371,319 2/1983 Murayama et al. .
4,411,600 10/1983 Itagaki et al. .
4,729,723 3/1988 Outzen .
4,982,812 1/1991 Hwang ..... 181/202

*Primary Examiner*—Leonard E. Smith
*Attorney, Agent, or Firm*—Harness, Dickey & Pierce

[57] ABSTRACT

There is disclosed an improved two-piece enclosure for a refrigerant compressor which is very simple in design and which effectively attenuates the sound produced by that compressor and, at the same time, requires a minimum amount of additional space and provides easy access to the compressor for service and the like. Two embodiments are shown, one with sound insulation on the walls of the container and another with sound insulation on the compressor.

8 Claims, 4 Drawing Sheets

SOUND ATTENUATION CHAMBER

The present invention relates generally to sound attenuation devices and more particularly to a sound attenuation chamber for refrigerant compressors.

Because such compressors are commonly noise producing when in operation, it is often desirable to attenuate or reduce the amount of noise transmitted to the surrounding environment. To accomplish this, typically the compressor is provided with a thicker or specially shaped shell or body, improved suction and discharge mufflers, or internal insulators; or it may be enclosed in a bulky insulated box. In known implementations of the last technique the enclosure is usually large and bulky, enclosing components of the refrigerant system other than the compressor, and are filled with liquid or otherwise such as to severely limit access to the compressor when service is required.

It is, therefore, an object of this invention to provide an improved enclosure or chamber for a refrigerant compressor which is very simple in design and which effectively attenuates the sound produced by that compressor and, at the same time, requires a minimum amount of additional space and provides easy access to the compressor for service and the like. This is accomplished by providing a novel two piece chamber defining structure, with one piece being detachably connected to the other to substantially enclose the compressor and yet being easily detached from the other to expose the compressor.

Other advantages and features of this invention will become apparent from the following specification taken in connection with the accompanying drawings.

DESCRIPTION OF THE PREFERRED EMBODIMENT

Figure 1:
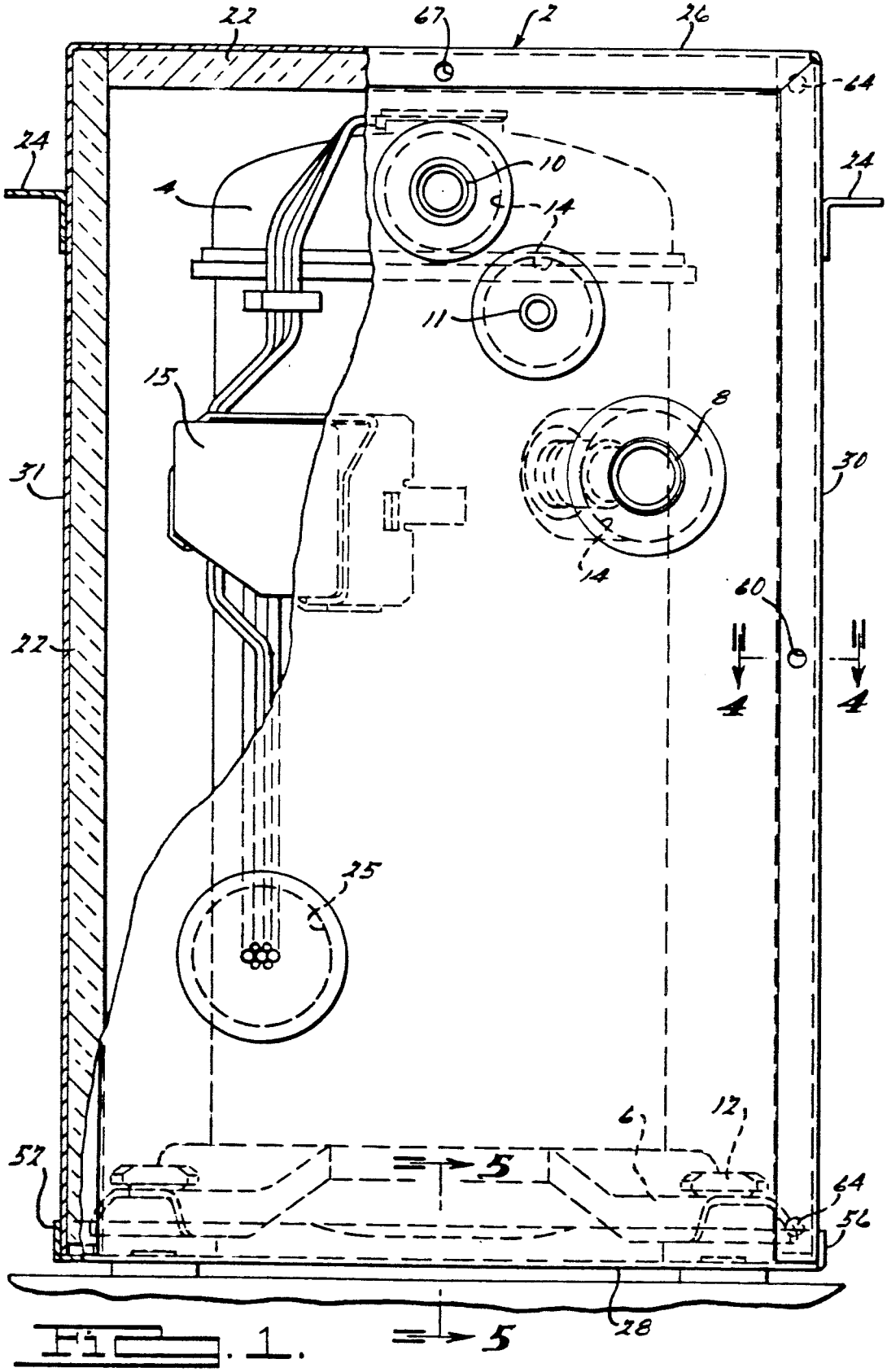
FIG. 1 is a front elevational view, with a portion cut away, of a refrigerant compressor mounted in and enclosed by a sound attenuation chamber embodying the principles of the present invention.
Figure 2:
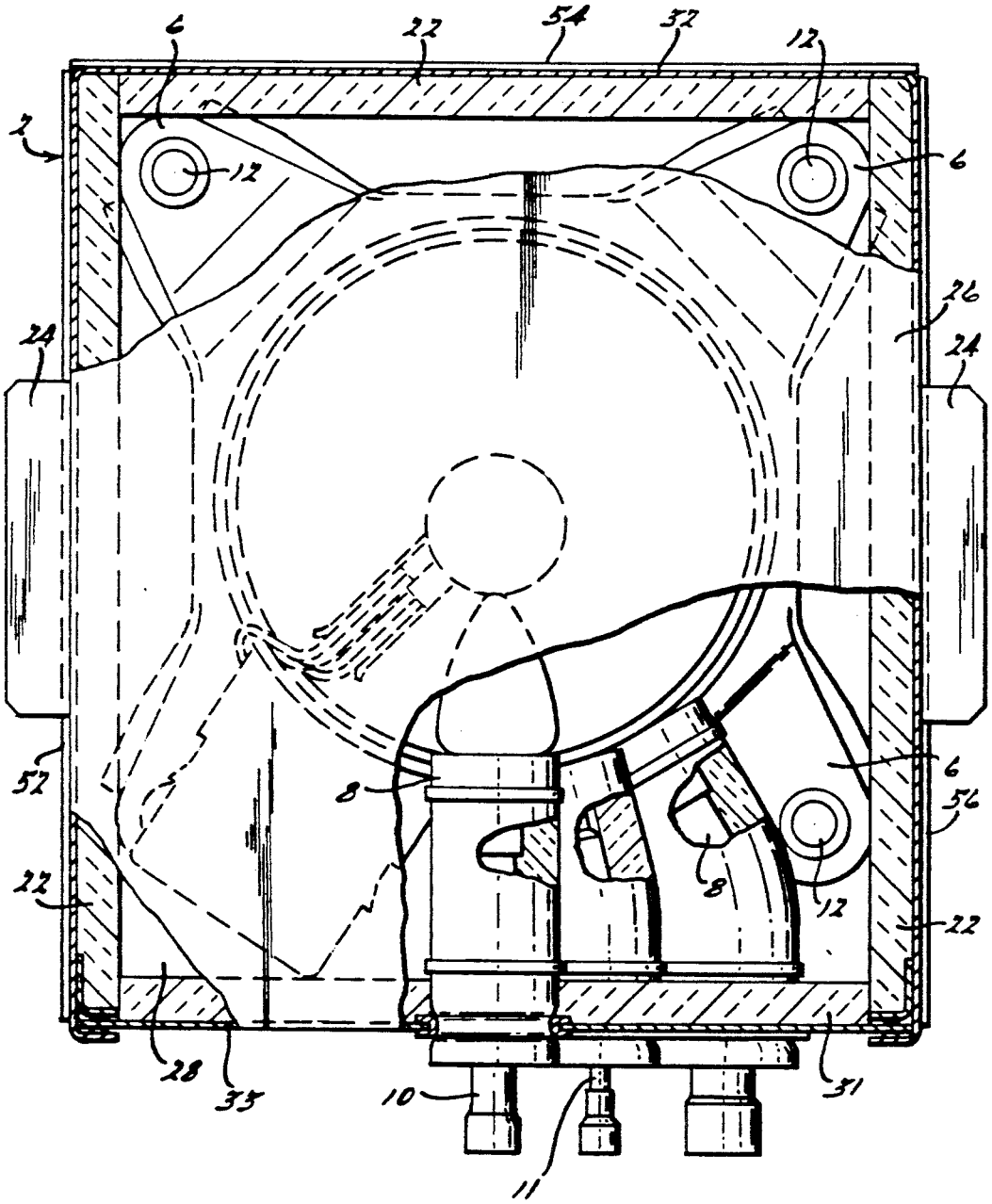
FIG. 2 is a top plan view, with a portion cut away, of the structure of FIG. 1.

Referring to FIGS. 1 and 2, the sound attenuation chamber of the present invention is illustrated generally at 2. The refrigerant compressor 4 contained therein has a plurality of connected mounting feet 6 as well as three inlet and outlet ports (not shown) to which are connected conduits 8, 10 and 11, respectively, for the passing of refrigerant medium and/or lubricant into and out of the compressor. Each of the conduits 8, 10 and 11 are covered with thermal insulation, as indicated at 13. The electrical wires for powering the compressor issue from the normal terminal box 15 and are indicated at 17.

Figure 3:
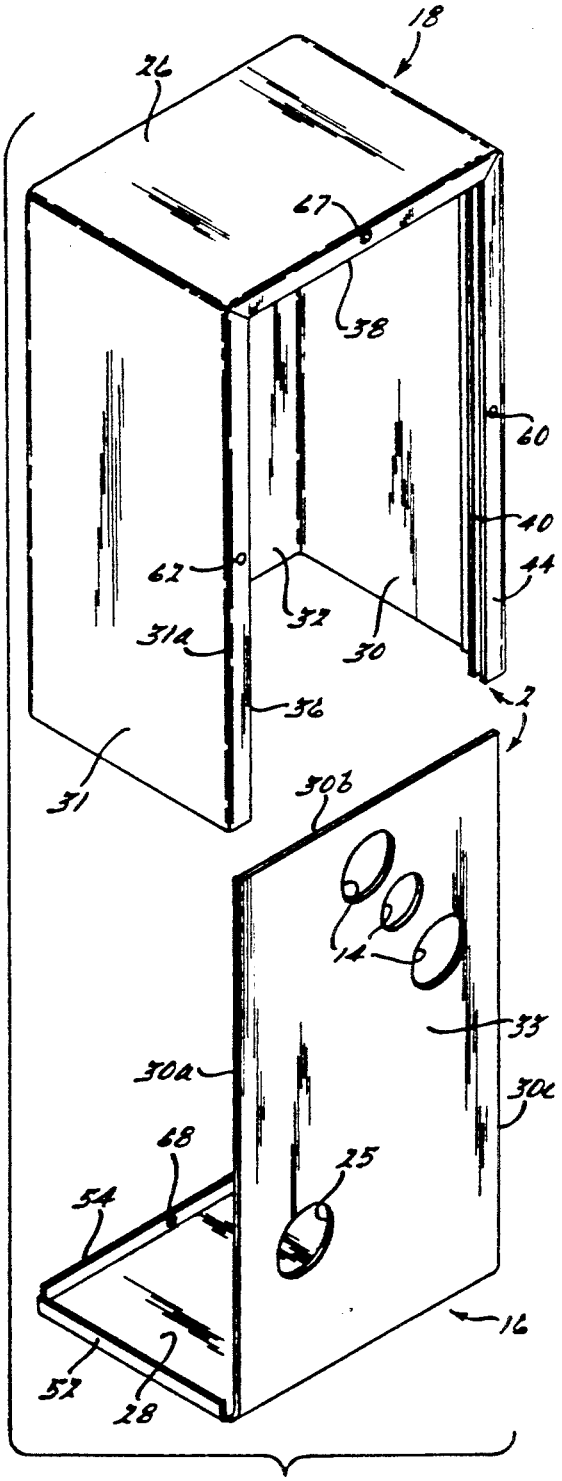
FIG. 3 is a perspective view of the two overall sections of the structure of FIG. 1 shown in stripped form and when detached from one another.

The attenuation chamber 2, in this exemplary embodiment, is shaped generally as a six-sided box having a top 26, bottom 28, and two sides 30 and 31, a backside 32 and a front side 33, although it could be cylindrical, or of any other suitable shape. The chamber 2 is further overall comprised of two sections, a first section 16 and a second section 18 (FIG. 3). First section 16 consists essentially of two integrally formed portions which generally comprise bottom 28 and front side 33. The compressor 4 is securely mounted to bottom 28 of first section 16 via its mounting feet 6 and bolts 12. Front side 33 has formed therein suitable apertures 14 through which the inlet and outlet conduits 8, 10, and 11 of the compressor pass. These apertures 14 are of appropriate size and are positioned such that a seal may be formed between these apertures 14 and the outside periphery of the insulation 13 on conduits 8, 10 and 11. In addition, front side 33 has an opening 25 in which is disposed an apertured grommet 27 through which wires 17 pass The inside face of front side 33 is provided with a layer 35 of sound deadening insulation. The insulation material may be any type that has the required sound absorbing properties, such as polyurethane foam, a fibrous mat, composite layers of metallic and non-metallic materials, or the like.

Second section 18 defining chamber 2 generally consists of four integrally formed portions, one portion forming top 26 of the chamber and the remaining three portions forming sides 30 and 31, and back 32. Each aforementioned portion of both first section 16 and second section 18 are further comprised of outer walls 20, each of which is lined with a layer 22 of similar sound insulation material. The side walls 30 and 31 also may have attached thereto handles 24 which are appropriately configured and positioned to aid in assembling and disassembling sections, 16 and 18.

Figure 4:
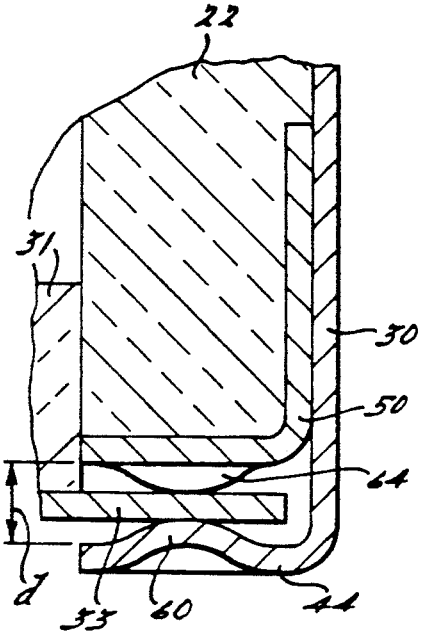
FIG. 4 is a sectional view taken generally along line 4—4 in FIG. 1.
Figure 5:
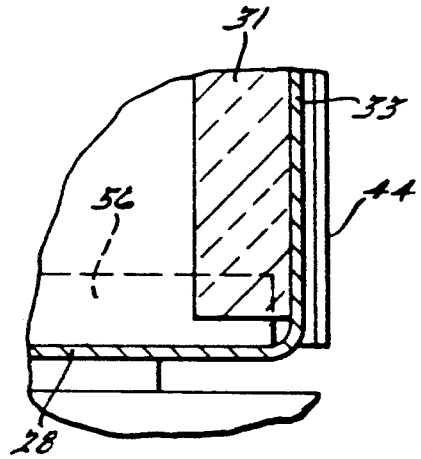
FIG. 5 is a sectional view taken generally along line 5—5 in FIG. 1.

As best shown in FIGS. 3 and 4, second section 18 in this exemplary embodiment has generally U-shaped channels 36, 38, and 40 disposed along the front edges of sides 30 and 31 and top 26. For purposes of clarity, reference will be made only to channel 40, channels 36 and 38 being substantially the same. As shown in FIGS. 3 and 4, channel 40 is defined in part by flange 44 which extends inwardly at substantially a right angle to side 30, and in part by an L-shaped element 50 which is disposed along flange 44 such that one leg of element 50 is fixably mounted to the inside of side 30 and the other leg of element 50 is disposed substantially parallel to flange 44, spaced apart therefrom at a distance d which is slightly greater than the thickness of front 33, as will be described in more detail below, alternatively, channels 36, 38, and 40 could be integrally formed with their respective sides and top.

Channels 36, 38, and 40 are adapted to slidably engage edges 30*a*, 30*b*, and 30*c* respectively of front side 33 when channels 36 and 40 are aligned above edges 30*a* and 30*c* as shown in FIG. 3 and second section 18 is then moved generally vertically downwardly. Upon slidable engagement of these channels to front 33, second section 18 is supported by first section 16 and is held in place by gravity. Additional flanges 52, 54, and 56 are also preferably provided on first section 16 to further locate and support second section 18. To access the compressor 4 for service and the like, second section 18 is merely lifted in an upward direction until channels 36, 38, and 40 clear side 30 and then moved away to fully reveal the compressor. Service can thus be effected without disconnecting any conduits or wiring.

In a preferred embodiment, a means is also provided to resiliently and frictionally retain second section 18 to first section 16. As shown in FIG. 4, generally convex dimples 60, 62, 64 and 67 are formed in both sides of U-shaped channels 36 and 40 to frictionally pinch front side 33 therebetween. As shown in FIG. 3, an additional dimple 68 can be formed on the inside of flange 54 to contact back side 32 of second section 18 to provide additional support therefor.

Figure 6:
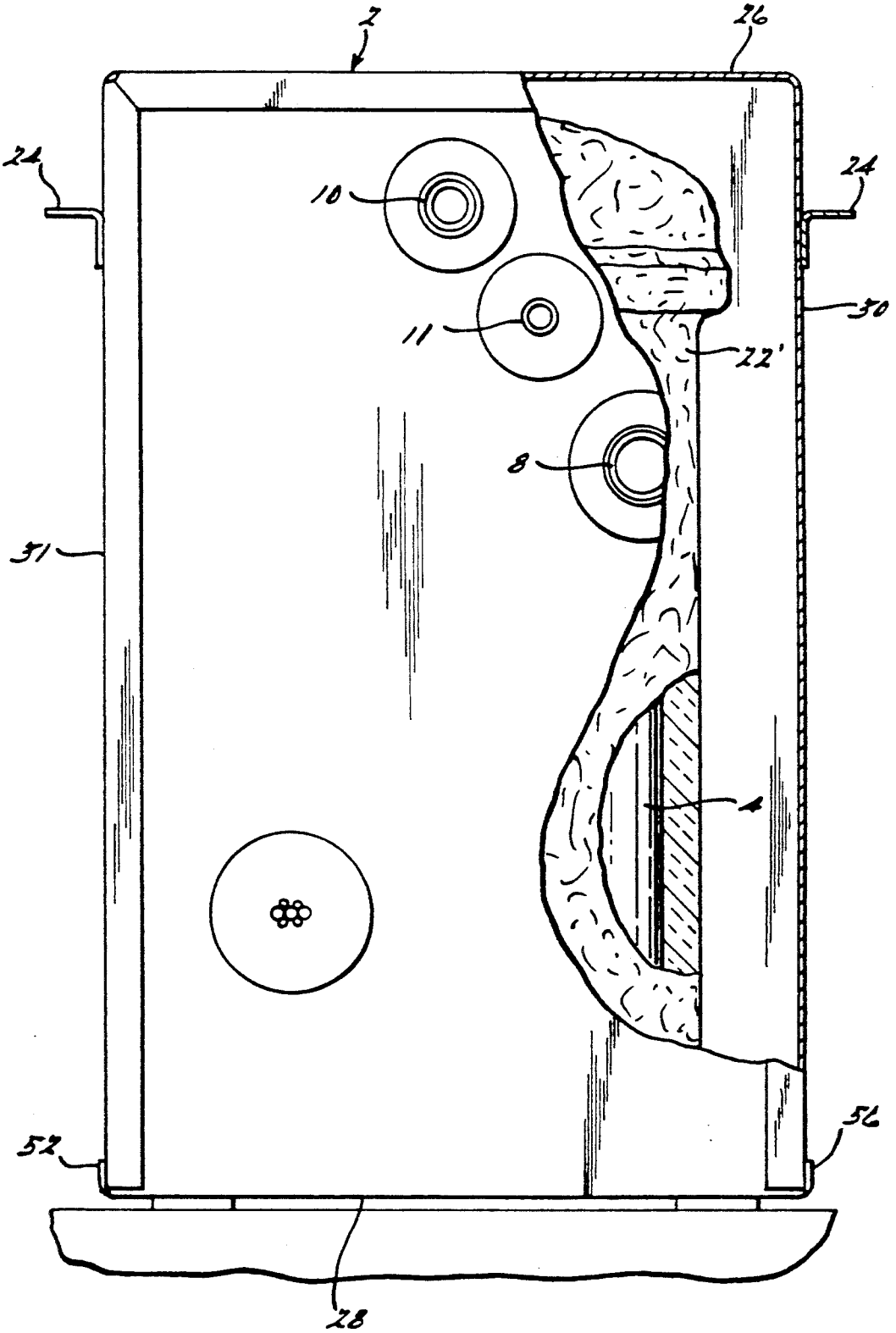
FIG. 6 is a view similar to FIG. 1 showing an alternative embodiment of the invention.

An alternative embodiment of the invention is shown in FIG. 6. In this embodiment the entire structure is the same as in the first embodiment with the sole exception that the sound insulating layer is placed on the external surface of compressor 4 rather than the inside surface of the walls defining chamber 2, as indicated at 22'. In this embodiment it is believed that the small amount of sound from the compressor which is not absorbed by layer 22' will be reflected back to layer 22' for absorption therein by the relatively hard interior surfaces of the walls defining chamber 2. As a further alternative in certain applications, it may be feasible to put layers of sound absorbing insulation on both the compressor and the inside walls of chamber 2.

The foregoing discussion discloses and describes an exemplary embodiment of the present invention. One skilled in the art will readily recognize from such discussion, and from the accompanying drawings and claims, that various changes, modifications, and variations can be made therein without departing from the spirit and scope of the invention as defined in the following claims.

It is claimed:

1. A sound attenuation enclosure for a heremetic refrigerant compressor having refrigerant conduits connected thereto, said enclosure comprising:

(a) a first relatively fixed section onto which the compressor is adapted to be affixed, said first section having at least one aperture formed therein through which at least one refrigerant conduit passes;

(b) a second section attachable to said first section so that both said sections define a chamber which substantially encloses the compressor, said second section being detachable from said first section to permit access to the compressor; and (c) means for attenuating the sound produced by the compressor comprising material having sound absorbing properties disposed in said chamber, said enclosure being shaped as a six-sided box, having a top, bottom, front, back and two sides wherein said second section is comprised of four integrally formed portions, one forming the top of said chamber and the remaining three forming two sides and the back of said chamber.

2. A sound attenuation enclosure for a heremetic refrigerant compressor having refrigerant conduits connected thereto, said enclosure comprising:

(a) a first relatively fixed section onto which the compressor is adapted to be affixed, said first section having at least one aperture formed therein through which at least one refrigerant conduit passes;

(b) a second section attachable to said first section so that both said sections define a chamber which substantially encloses the compressor, said second section being detachable from said first section to permit access to the compressor; and (c) means for attenuating the sound produced by the compressor comprising material having sound absorbing properties disposed in said chamber, said enclosure being shaped as a six-sided box, having a top, bottom, front, back and two sides wherein said second section is comprised of four integrally formed portions, one forming the top of said chamber and the remaining three forming two sides and the back of said chamber, said second portion being slidably attachable to said first section along corresponding longitudinal edges.

3. A sound attenuation enclosure for a heremetic refrigerant compressor having refrigerant conduits connected thereto, said enclosure comprising:

(a) a first relatively fixed section onto which the compressor adapted to be affixed, said first section having at least one aperture formed therein through which at least one refrigerant conduit passes;

(b) a second section attachable to said first section so that both said sections define a chamber which substantially encloses the compressor, said second section being detachable from said first section to permit access to the compressor; and (c) means for attenuating the sound produced by the compressor comprising material having sound absorbing properties disposed in said chamber, said enclosure being shaped as a six-sided box, having a top, bottom, front, back and two sides wherein said second section is comprised of four integrally formed portions, one forming the top of said chamber and the remaining three forming two sides and the back of said chamber, said second portion being slidably attachable to said first section along corresponding longitudinal edges and said second section sliding generally vertically with respect to said first section.

4. A sound attenuation enclosure for a heremetic refrigerant compressor having refrigerant conduits connected thereto, said enclosure comprising:

(a) a first relatively fixed section onto which the compressor adapted to be affixed, said first section having at least one aperture formed therein through which at least one refrigerant conduit passes;

(b) a second section attachable to said first section so that both said sections define a chamber which substantially encloses the compressor, said second section being detachable from said first section to permit access to the compressor; and (c) means for attenuating the sound produced by the compressor comprising material having sound absorbing properties disposed in said chamber, said enclosure being in the shape of a six-sided box, having a top, bottom, front, back and two sides, said first section being comprised of two integrally formed portions, a first portion forming the bottom of said chamber and a second portion forming the front of said chamber and wherein the compressor is mounted to the first portion of said first section and said aperture is formed in said second portion of said first section.

5. The enclosure as claimed in claim 4 wherein said material having sound absorbing properties is disposed as a lining disposed within and attached to the walls of said first and second sections.

6. The chamber as claimed in claim 4 wherein said material having sound absorbing properties is disposed on the outside of and attached to the compressor.

7. The chamber as claimed in claim 4 wherein a channel shaped portion is disposed along edges of at least one of said first section and said second section, to facilitate the attaching and detaching of said sections from one another.

8. The chamber as claimed in claim 7 further comprising a plurality of generally convex arcuate protrusions disposed on at least one wall of said channel shaped portion. said protrusions being arranged to frictionally engage the edge of said other of said second section and said first section.

* * * * *

UNITED STATES PATENT AND TRADEMARK OFFICE

CERTIFICATE OF CORRECTION

PATENT NO. : 5,151,018

DATED : September 29, 1992

INVENTOR(S) : Harry B. Clendenin and James F. Fogt

It is certified that error appears in the above-identified patent and that said Letters Patent is hereby corrected as shown below:

Col. 2 line 16, after "pass" insert -- . --.

Col. 2 line 48, ", alternatively" should be -- . Alternatively --.

Col. 4 lines 11-12, after "compressor" insert -- is --.

Col. 4, lines 37-38, after "compressor" insert -- is --.

Signed and Sealed this

Twenty-eighth Day of December, 1993

*Attest:*

Bruce Lehman

BRUCE LEHMAN

*Attesting Officer*

*Commissioner of Patents and Trademarks*